US005269075A

United States Patent [19]

Brunnmair et al.

[11] Patent Number: 5,269,075

[45] Date of Patent: Dec. 14, 1993

[54] APPARATUS FOR INTERCONNECTING TWO GROUPS OF DRIERS OF A PAPERMAKING MACHINE

[75] Inventors: Erwin Brunnmair; Reinhard Pinter, both of Graz, Austria; Herbert Holik, Ravensburg; Werner Leitenberger, Schlier, both of Fed. Rep. of Germany

[73] Assignee: Sulzer Escher Wyss GmbH, Ravensburg, Fed. Rep. of Germany

[21] Appl. No.: 895,652

[22] Filed: Jun. 9, 1992

[30] Foreign Application Priority Data

Jun. 10, 1991 [DE] Fed. Rep. of Germany ..... 4119068

[51] Int. Cl.[5] ..... F26B 13/08

[52] U.S. Cl. ..... 34/117; 34/114

[58] Field of Search ..... 34/117, 120, 116, 114, 34/115

[56] References Cited

U.S. PATENT DOCUMENTS 5,065,529 11/1991 Skaugen et al. ..... 34/120 X

FOREIGN PATENT DOCUMENTS 0344088 11/1989 European Pat. Off. .
0428768 5/1991 European Pat. Off. .
9001210 5/1990 Fed. Rep. of Germany .
90012097 5/1990 Fed. Rep. of Germany .
90166019 4/1991 Fed. Rep. of Germany .

*Primary Examiner*—Henry A. Bennet
*Attorney, Agent, or Firm*—Sandler Greenblum & Bernstein

[57] ABSTRACT

The apparatus for interconnecting two groups of driers of a papermaking machine serves to interconnect two successive drying sections through which successively travels a paper web which is dried by such successive drying sections. When needed or desired, such interconnection must be interrupted. For this purpose there are used additional elements which are capable of bringing about a separation of the endless drying wires associated with the respective web drying sections and, at the same time, during normal operation, that is, during the transfer of the paper web from the one to the other drying section, affording a regulatable operation capable of retaining the quality of the paper web. Thus, for this purpose there are proposed the use of adjustable rollers and also suction boxes operated under vacuum conditions.

18 Claims, 5 Drawing Sheets

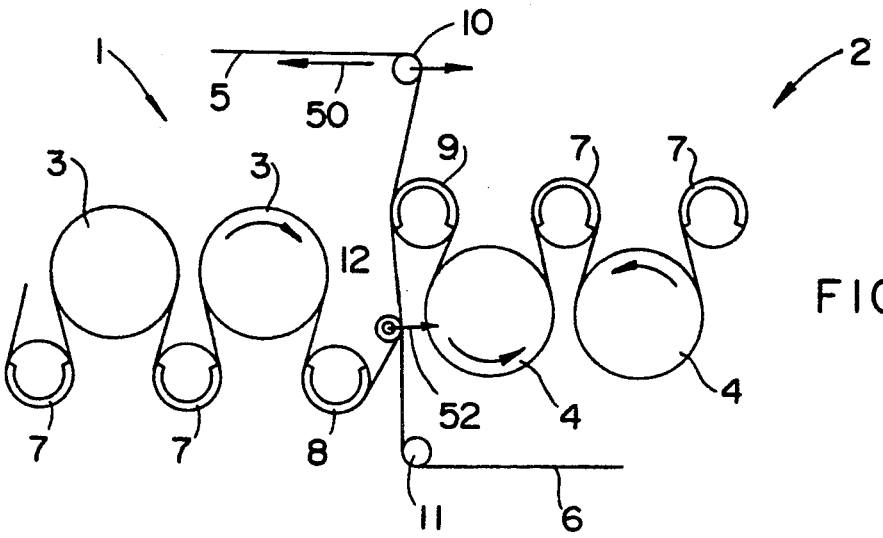
FIG. 1
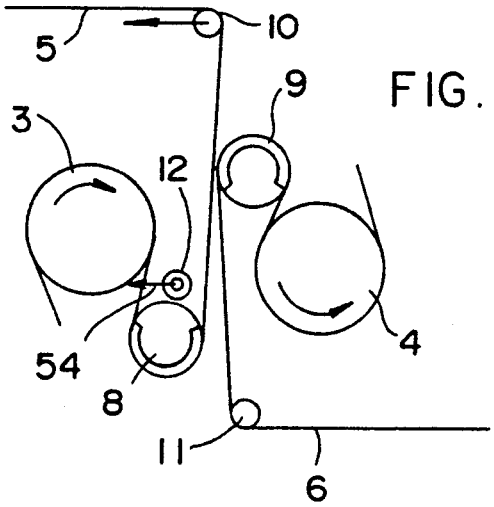
FIG. 1a
FIG. 2
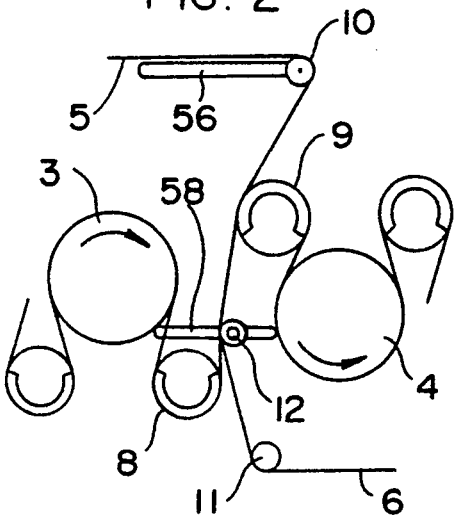
FIG. 2a
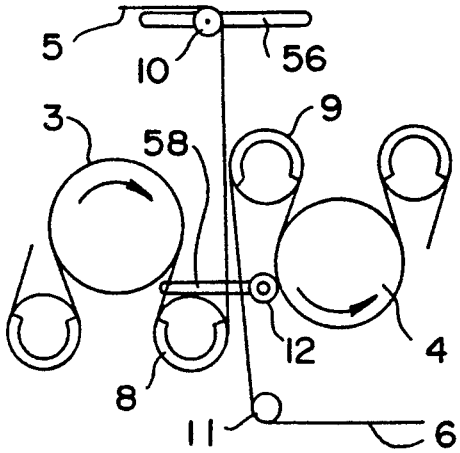

FIG. 4
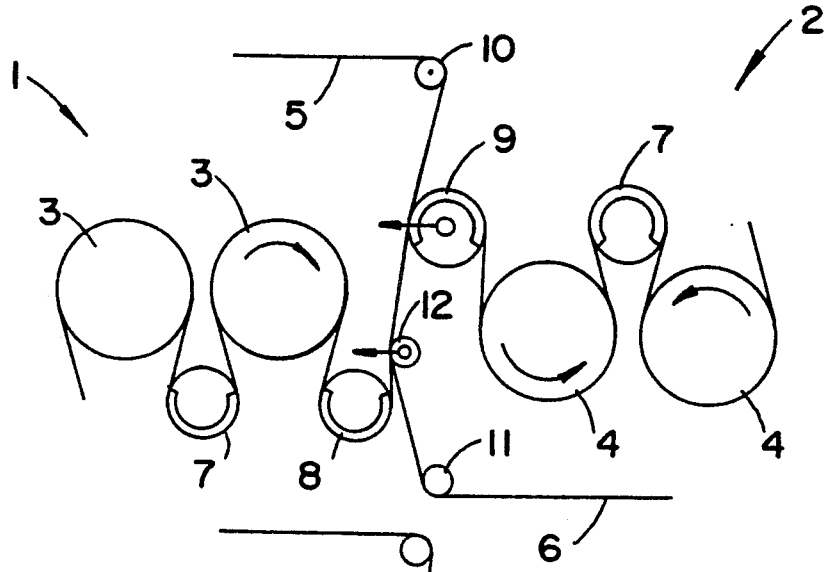
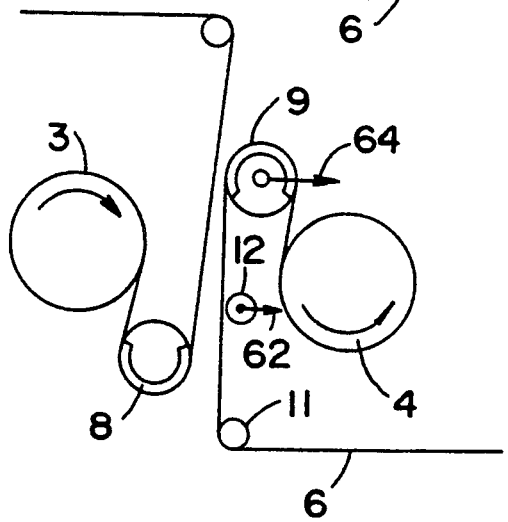
FIG. 4a

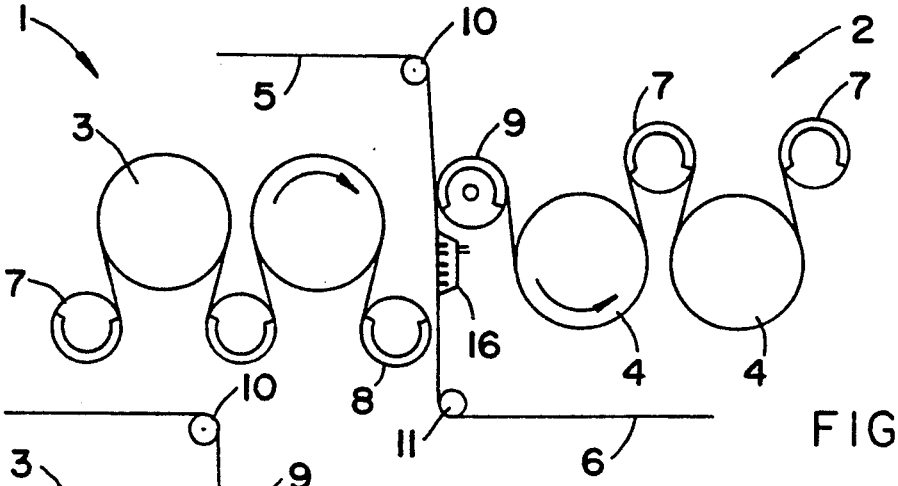
FIG. 5
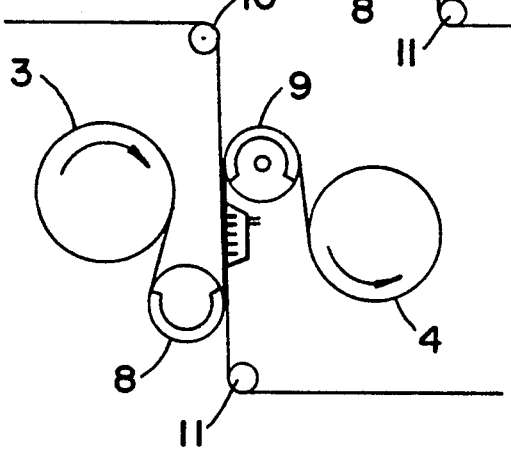
FIG. 5a
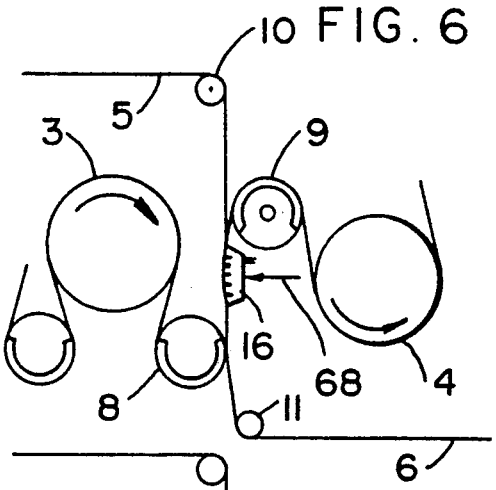
FIG. 6
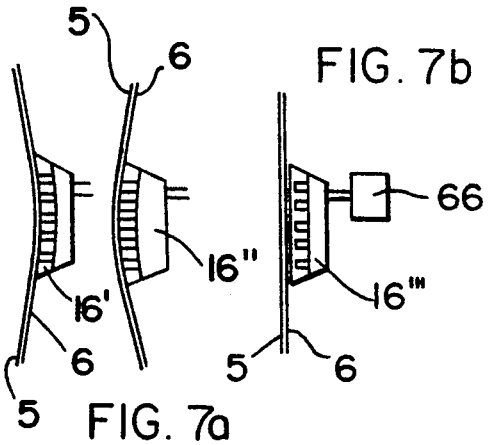
FIG. 7b
FIG. 7a
FIG. 7
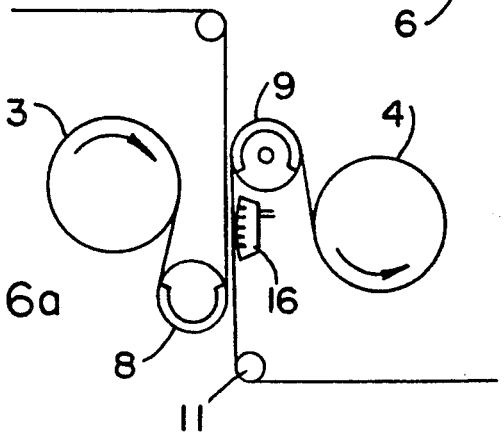
FIG. 6a

APPARATUS FOR INTERCONNECTING TWO GROUPS OF DRIERS OF A PAPERMAKING MACHINE

BACKGROUND OF THE INVENTION

1. Field of the Invention

The present invention relates to a new and improved apparatus for interconnecting two groups of driers of a papermaking machine.

Generally speaking, the apparatus for interconnecting two groups of driers of a papermaking machine, wherein the groups of driers are suitable for drying a paper web, according to the present development is of the type wherein the paper web is guided together with at least one endless drying wire over heated drying devices, especially drying cylinders or rollers, in such a manner that the paper web is located between the drying wire and an associated drying device. At least two groups of driers successively follow one another in a predetermined direction of travel of the paper web through such groups of driers. At a transition location between the two groups of driers the paper web is guided from the one preceding group of driers into the next following or successive group of driers in such a manner that the opposite side of the paper web, which is situated opposite to the side of the paper web contacted or dried by the preceding group of driers and which faced the drying devices thereof, is now located in the direction of the drying devices of such next following group of driers. In this next following group of driers there is used a different endless drying wire than the endless drying wire used in the preceding group of driers. As viewed in the predetermined direction of travel of the paper web, downstream of the last drying device of the preceding group of driers there is provided at least one deflection roller for deflection of the endless drying wire together with the paper web as well as a following deflection roller for the drying wire which at that location is without or no longer carries the paper web. In the following group of driers at a location upstream of the first drying device of this following group of driers the endless drying wire of such following group of driers is guided over a deflection roller to the endless drying wire of the preceding group of driers and forms together with the paper web and the endless drying wire of the preceding group of driers a contact region. Following separation of the endless drying wire of the preceding group of driers from the paper web the endless drying wire of the following group of driers is guided in conjunction with the paper web over a deflection device belonging to the following group of driers and from which the paper web can then be guided to the first drying device of the following group of driers.

2. Discussion of the Background and Material Information

In the German Petty Patent No. 90 01 209.7, granted Apr. 5, 1990, there is disclosed an apparatus for connecting or interconnecting two groups of driers of a papermaking machine and, when necessary, separating or disconnecting such two groups of driers. The separation of two successive groups of driers, as is known in the papermaking art, can be desired when one group of driers should be stopped for operational reasons, but at the same time the other group of driers should remain operational. With this known solution there can be adjusted, for instance, an upper situated drying wire-guide roll into a number of positions, with the result that there can be varied both the wrap angle of a lower situated suction deflection roller, from where the paper web is transferred from the one group of driers to the other group of driers, and there can be effectuated a separation or disconnection of both groups of driers from one another.

However, prior art web transfer apparatuses of this type are afflicted with the drawback that the transfer of the paper web from one to the other felt must be accomplished along a relatively short path. This can result in uncertainty in the web transfer operation, or there can result, during web transfer, with a corresponding large wrap angle, impairment in the quality of the sensitive paper web.

SUMMARY OF THE INVENTION

Therefore, with the foregoing in mind, it is a primary object of the present invention to provide an improved apparatus for interconnecting two groups of driers of a papermaking machine in a manner which is not afflicted with the aforementioned shortcomings and drawbacks of the prior art.

Another and more specific object of the present invention aims at providing an improved web transfer apparatus at the transition location between two successive groups of driers, by means of which it is possible to accomplish, with the use of relatively simple means, a positive, quality-protective transfer of the paper web from the drying wire of a preceding or upstream group of driers to the drying wire of the next following or downstream group of driers, while at the same time providing, when needed, the possibility of separating both drying wires from one another through such a distance that these drying wires can move past one another without contacting one another.

Still a further noteworthy object of the present invention concerns the provision of an improved apparatus for interconnecting two groups of driers of a papermaking machine which apparatus is relatively simple in construction and design, extremely reliable in operation, not readily subject to breakdown or malfunction and executes positive and protective transfer of a paper web from one group of driers to the next following group of driers.

As previously explained, the present invention is directed to an apparatus for interconnecting two groups of driers of a papermaking machine, wherein the groups of driers are suitable for drying a paper web. Such apparatus comprises at least two groups of driers successively following one another in a predetermined direction of travel of the paper web through the at least two groups of driers. These at least two groups of driers comprise a plurality of heated drying devices, especially drying cylinders, for drying the paper web, and endless tensioned drying wire means serve for guiding the paper web over the plurality of heated drying devices in such a manner that the 10 paper web is located between the endless drying wire means and an associated one of the drying devices. The at least two groups of driers define a transition location where the paper web is transferred from an upstream located one of the at least two groups of driers to a next following downstream located one of the at least two groups of driers as viewed with respect to the predetermined direction of travel of the paper web through such at least two groups of driers. The paper web is guided from the upstream located group of driers into the next following downstream located group of driers at the transition location between the two groups of driers in such a manner that a side of the paper web which is situated opposite to the side of the paper web which confronted the drying devices of the upstream group of driers now is located in confronting or coacting relationship with the drying devices of the next following downstream located group of driers.

The endless drying wire means advantageously comprises a first endless drying wire for the upstream located group of driers and a separate second endless drying wire for the downstream located group of driers. At least one deflection roller for the first drying wire and the paper web carried thereby is provided for the upstream located group of driers downstream of a last or terminal one of the drying devices of this upstream located group of driers. A further deflection roller is provided for the first drying wire which is arranged downstream of the at least one deflection roller as viewed with respect to the predetermined direction of travel of the paper web through said at least two groups of driers. This further deflection roller serves to deflect the first drying wire at a location where such first drying wire no longer carries the paper web. The downstream located group of driers comprises a deflection roller or roller member arranged upstream of a first drying device of the second group of driers as viewed with respect to the predetermined direction of travel of the paper web through the at least two groups of driers. This deflection roller of the second group of driers guides the second endless drying wire of the second group of driers towards the first endless drying wire of the upstream group of driers such that the second endless drying wire together with the first drying wire and the paper web arranged between the first and second drying wires forms a contact region. A deflection device is provided for the downstream arranged group of driers over which there is guided the second endless drying wire following separation of the first endless drying wire of the upstream located group of driers from the paper web. This deflection device serves for guiding the paper web to the first or initial drying device of the downstream located group of driers.

According to important aspects of the present invention, there are provided, among other things, further devices or means which are capable of altering the course of at least one of the endless drying wires at the region between the at least two groups of driers such that, when necessary, there is possible the separation of the first and second drying wires between the at least two groups of driers.

With respect to a further aspect, the means for altering the course of at least one of the endless drying wires comprises a cleaning roller located above the deflection device which is arranged upstream of the first drying device of the second group of driers and which guides the paper web located between the first and second drying wires. Means serve to move this cleaning roller in the direction of the first drying wire of the upstream group of driers such that in one position of the cleaning roller, in an operating position of the apparatus, both of the first and second drying wires can be placed and retained in contact with one another and in another position of the cleaning roller the first drying wire of the upstream group of driers can be separated from the second drying wire of the downstream group of driers.

Still further, the deflection roller member for the downstream located group of driers is positioned at a location directly upstream of the transition location as viewed with respect to the predetermined direction of travel of the paper web through the at least two groups of driers, and means are provided for altering the position of the deflection roller member in order to augment separation of the first and second drying wires from one another.

It is further contemplated that the at least one deflection roller for the first drying wire located downstream of the last or terminal one of the drying devices of the upstream located group of driers comprises a displaceable deflection roller in order to augment separation of the first and second drying wires from one another.

Moreover, the deflection device provided for the downstream arranged group of driers over which there is guided the second endless drying wire can comprise a displaceable deflection device in order to augment separation of the first and second drying wires from one another.

According to a further aspect of the present invention, an adjustable contact roller is located between the at least two groups of driers which, in an operating position of the apparatus, places and retains the first and second drying wires in contact with one another. This adjustable contact roller is movable away from the first and second drying wires such that owing to tension of the first and second drying wires these first and second drying wires are separated from one another.

Still further, such adjustable contact roller can be constructed as a regulatable or controllable contact roller in order to be able to regulate or control the force with which such adjustable contact roller is applied against the first and second drying wires.

There also may be provided a displaceable deflection means for at least one of the drying wires and the paper web and which is located at the transition location between the at least two groups of driers in order to enable separation of the first and second drying wires from one another. Such deflection means may comprise the at least one deflection roller provided for the first drying wire or the deflection device provided for the downstream arranged group of driers.

As to the means for altering the course of at least one of the endless drying wires such may comprise a suction box located between the at least one deflection roller provided for the first drying wire and the deflection device. Such suction box is advantageously positionable such that due to vacuum conditions prevailing in the suction box both the first an second drying wires and the paper web located therebetween are placed into contact with one another, and in the absence of the vacuum conditions in the suction box the first and second drying wires are released from one another and can move past one another without contacting one another.

This suction box can possesses a substantially concave or convex configuration or even a substantially straight or linear configuration with respect to the first and second drying wires.

Still further, there can be provided means for controlling or regulating the vacuum conditions prevailing in the suction box.

Also the suction box located between the at least one deflection roller provided for the first drying wire and the deflection device can be movable in the direction of the first and second drying wires to such an extent that the suction box comes into contact with a neighboring one of the first and second drying wires and displaces such neighboring drying wire together with the paper web into or towards the other drying wire.

By virtue of the inventive apparatus constructions there is ensured that at the transition region between two successive groups of driers the transfer of the paper web from the preceding or upstream drying wire to the next following or downstream drying wire can be accomplished such that at a certain region or location the paper web is retained at both sides or faces, that is, is retained by both endless drying wires, and thus, such paper web can be positively transferred from the preceding or upstream located drying wire to the next following or downstream located or succeeding drying wire. With certain specific constructional embodiments it is possible to control in a relatively simple manner the force with which the paper web should be pressed against the drying wire or wires, as the case may be. By virtue of the fact that the aforementioned further devices or means can alter the travel course of at least one of the drying wires, it is possible to separate both of the groups of driers. The action exerted for altering the course of the drying wire or wires can be undertaken by direct contact thereat, for example, by using rollers or by application of vacuum or suction conditions.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures there have been generally used the same reference characters to denote the same or analogous components, and wherein:

FIG. 1 is a schematic side view of a first exemplary embodiment of apparatus for interconnecting two groups of driers of a papermaking machine;

FIG. 1*a* illustrates the apparatus of FIG. 1 in an open condition between the two successive groups of driers;

FIG. 2 is a schematic side view of a second exemplary embodiment of apparatus for interconnecting two groups of driers of a papermaking machine;

FIG. 2*a* illustrates the apparatus of FIG. 2 in an open condition between the two successive groups of driers;

FIG. 4 is a schematic side view of a fifth exemplary embodiment of apparatus for interconnecting two groups of driers of a papermaking machine;

FIG. 4*a* illustrates the apparatus of FIG. 4 in an open condition between the two successive groups of driers;

FIG. 5 is a schematic side view of a sixth exemplary embodiment of apparatus for interconnecting two groups of driers of a papermaking machine;

FIG. 5*a* illustrates the apparatus of FIG. 5 in an open condition between the two successive groups of driers;

FIG. 6 is a schematic side view of a seventh exemplary embodiment of apparatus for interconnecting two groups of driers of a papermaking machine;

FIG. 6*a* illustrates the apparatus of FIG. 6 in an open condition between the two successive groups of driers;

FIGS. 7, 7*a* and 7*b* respectively schematically depict different constructions of suction boxes which can be used in the various embodiments of the present invention;

DETAILED DESCRIPTION OF THE PREFERRED EMBODIMENTS

Figure 3:
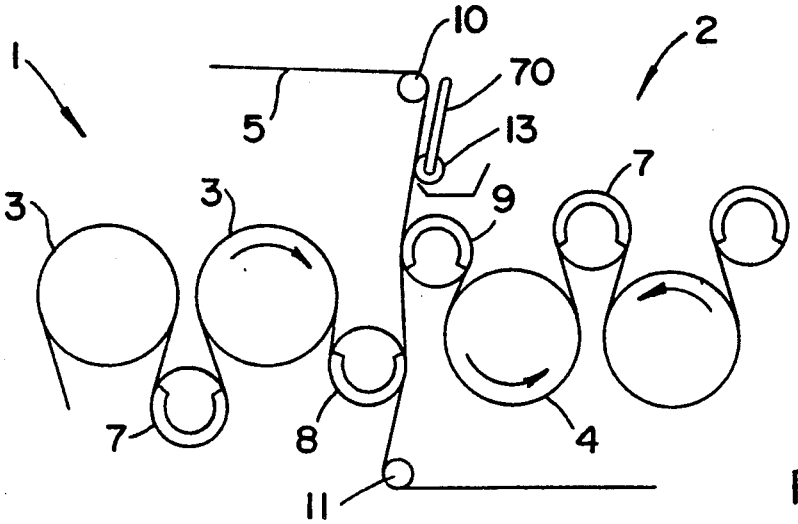
FIG. 3 is a schematic side view of a third exemplary embodiment of apparatus for interconnecting two groups of driers of a papermaking machine.

Describing now the drawings, it is to be understood that only enough of the construction of the different embodiments of apparatuses for interconnecting two groups of driers of a papermaking machine and the papermaking machine itself have been depicted therein, in order to simplify the illustration, as needed for those skilled in the art to readily understand the underlying principles and concepts of the present invention.

With more specific reference now made to the drawings, it is here pointed out that FIGS. 1 to 6*a* and 8 and 8*a* in each case depict the transition or web transfer region or location between a preceding or upstream arranged group of driers 1 and a next following or succeeding or downstream arranged group of driers 2. In each of the groups of driers 1 and 2 there are used drying cylinders or rollers 3 and 4, respectively, and tensioned endless drying wires 5 and 6, respectively, or equivalent drying elements as generally known in the papermaking art. Usually, although not necessarily, deflection rollers 7, 8 and 9, here depicted by way of example as suction rollers, are located between the drying cylinders 3 and 4. By means of these deflection rollers 7, 8 and 9, defining deflection devices, the drying wires 5 and 6, together with the paper web, are collectively turned or deflected and then can be delivered to the next following or downstream located drying cylinder of the associated group of driers 1 and 2, as the case may be. As concerns the present invention, particular attention is to be paid to the last deflection roller 8 of the preceding or upstream group of driers 1 as well as to the first deflection roller 9 of the next following or downstream group of driers 2, and furthermore, to the last wire guide or deflection roller or roll 10 of the preceding group of driers 1 and the first wire guide or deflection roller or roll 11 of the next following group of driers 2.

With that general background in mind as concerns the different exemplary embodiments of apparatuses of the present development, and now directing specific attention first to the embodiment of FIGS. 1 and 1*a*, it will be seen that a contact or press roller or roll 12 is located between both deflection rollers or deflection devices 8 and 9 of the here depicted two successive groups of driers 1 and 2. In its working position as depicted in FIG. 1, this contact roller 12 is pressed or urged against the outgoing or outbound portion of the endless drying wire 5. In order to move such contact roller 12 the same may be provided with any suitable adjustment or positioning device, like for instance a displaceable or pivotable adjustment lever, such as the lever 70 associated with a cleaning roller 13 to be considered shortly with reference to FIGS. 3, 3*a* and 3*b*. Furthermore, as viewed in the predetermined direction of travel of this drying wire 5, as generally indicated by the arrow 50, a region is present downstream or after such contact roller 12 where both of the first and second drying wires 5 and 6 and the intermediately situated paper web form an integrated or composite structure. By adjusting the force with which there is applied the contact or press roller 12 in the direction of the arrow 52 against the endless drying wire 5 there can be produced a regulating action as concerns the connection or contact between the paper web and endless drying wire. Furthermore, as will be seen by referring to FIG. 1*a*, by appropriately displacing or pivoting the contact roller 12 in the direction of the arrow 54 away from the drying wires 5 and 6 there is achieved a separation between the two groups of driers 1 and 2.

The modified embodiment depicted in FIGS. 2 and 2*a* constitutes a similar arrangement to that shown in FIGS. 1 and 1*a*, wherein, here however, the contact roller 12 is pressed against the second drying wire 6 of the next following or downstream arranged group of driers 2 as considered with respect to the direction of travel of the paper web between the two successive groups of driers 1 and 2. It will be apparent that, just as in the prior arrangement of FIGS. 1 and 1*a*, the paper web moves from the first or upstream group of driers 1 to the next following or downstream group of driers 2, in other words, from the left to the right of the showing of the drawings. Moreover, upon opening the two groups of driers 1 and 2, here not only the contact roller 12 but also the wire guide or deflection roller 10 of the preceding group of driers 1 is shifted in position, as particularly evident by inspecting FIG. 2*a*. In particular, the wire guide roller 10 is displaced within its displacement slot or guide 56 towards the left from the position shown in FIG. 2 and the contact roller 12 is displaced in its displacement slot or guide 58 towards the right of the position shown in such FIG. 2, resulting in separation or opening of the drying wires 5 and 6, as shown.

Figure 3A:
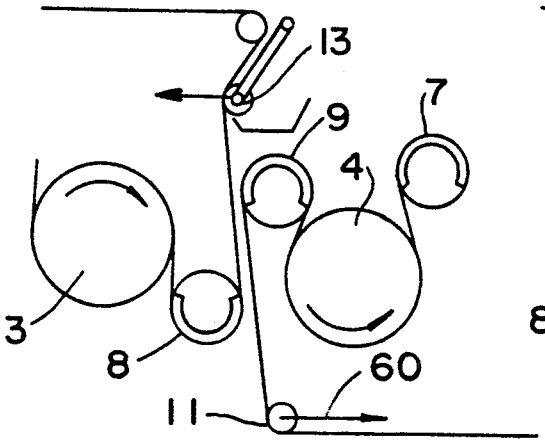
FIG. 3*a* illustrates the apparatus of FIG. 3 in an open condition between the two successive groups of driers.
Figure 3B:
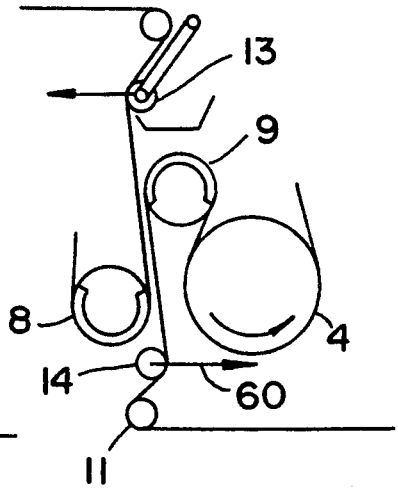
FIG. 3*b* illustrates a further modification of the apparatus of FIG. 3 and again depicts such in an open condition between the two successive groups of driers.

With reference now to FIGS. 3, 3*a* and 3*b*, there is here beneficially employed for separation of the two successive groups of driers 1 and 2 from one another the cleaning roller or roll 13 which is usually required in any event. This cleaning roller 13 is pressed against the outbound drying wire 5 of the first or upstream located group of driers 1 by means of the associated displaceable or pivotable lever 70 constituting an adjustment means or element for such cleaning roller 13. It will be observed that this cleaning roller 13 contacts the drying wire 5 at the region thereof moving away from the connection or contact region or location between the two groups of driers 1 and 2 and thus cleans such outbound region of the drying wire 5. When necessary or desired for the separation of the groups of driers 1 and 2 from one another, this cleaning roller 13 is displaced more intensely into contact with the neighboring drying wire, here, for example, the drying wire 5, so that such drying wire 5 positively lifts-off of the coacting drying wire 6 of the downstream or next following group of driers 2. As shown in the arrangements of FIGS. 3*a* and 3*b*, by displacing a lower wire guide roller (FIG. 3*a*) or by displacing an additional or supplementary separation roller 14, in the direction of the indicated arrows 60, there can be accomplished the complete separation of the drying wires 5 and 6 of both groups of driers 1 and 2 from one another.

Just as was the case for the embodiment of FIGS. 1 and 1*a*, in the modified embodiment depicted in FIGS. 4 and 4*a* there also can be provided a contact or press roller or roll 12 between both of the deflection or turning rollers 8 and 9. Here also there is formed a coherent or composite region containing both of the drying wires 5 and 6 and the paper web sandwiched therebetween. In the event that the two groups of driers 1 and 2 are to be separated from one another, then as depicted in FIG. 4*a* apart from appropriately shifting the displaceable contact roller 12 away from the associated drying wire, here the wire 6 in the direction of the depicted arrow 62, also the displaceable deflection roller 9 is displaced away from the drying wires 5 and 6, and specifically to the right of the showing of FIG. 4*a* away from the drying wire 5 in the direction of the arrow 64, resulting in very short displacement paths of these displaceable rollers 9 and 12 in order to effectuate opening of the two groups of driers 1 and 2. The contact roller 12 can be adjustably mounted in any suitable manner, as, for example, shown in the exemplary depicted arrangement of FIGS. 2 and 2*a*, in a slotted guide 58. Equally, the deflection roller 9 can be appropriately displaceably mounted in any suitable manner, as, for instance, upon a displaceable or pivotable lever or equivalent structure, like the adjustment or displacement lever 70 previously considered with respect to the cleaning roller 13 shown in FIG. 3.

The apparatus constructions of the embodiments depicted in FIGS. 5 and 5*a* and 6 and 6*a*, respectively, do not require the use of any displaceable or movable rollers to accomplish the separation and closing, as the case may be, of the two groups of driers 1 and 2. Here there is instead used at least one suction box 16 which is operated under vacuum or negative pressure conditions, which can be controlled by any suitable vacuum control or regulating means, generally indicated, for instance, in FIG. 7*b* by reference numeral 66. This at least one suction box 16 is mounted at a location between both of the deflection rollers 8 and 9, and specifically in such a manner that the drying wire 6 of the next following or downstream group of driers 2, moves in close contact with or at a close spacing to and past such suction box 16. The drying wire 5 of the preceding or upstream group of driers 1 travels, in turn, at a slight spacing from the drying wire 6 past the suction box 16 without contacting such drying wire 6 and the paper web located thereupon.

Continuing, as shown in FIG. 5, in the event a vacuum is applied to the suction box 16, then the drying wire 6 and the paper web located thereon or both drying wires 5 and 6 and the therebetween sandwiched paper web are collectively drawn against or towards such vacuum box 16. As a result, there can be accomplished in an ideal fashion the transfer of the paper web from the preceding drying wire, here the first endless drying wire 5, to the next following or downstream located drying wire, here the second endless drying wire 6. With these embodiments it is possible to simply separate or open the two groups of driers 1 and 2 by shutting-off the vacuum of the suction box 16.

As particularly well depicted in the embodiment of FIGS. 6 and 6*a*, under certain circumstances it can be advantageous to construct the suction box 16 to be displaceable in the direction of the drying wires 5 and 6, as indicated by the arrow 68, through the use of any suitable displacement mechanism, such as previously considered herein. Such use of a displaceable suction box 16 can simplify or facilitate the separation of and connection between, as the case may be, the two groups of driers and 2, even though such modification requires a somewhat greater equipment expenditure owing to the displaceability of the suction box.

FIGS. 7, 7*a* and 7*b* respectively depict three different contours Or constructions of suction boxes 16', 16'' and 16'41 . More specifically, FIG. 7 depicts a concave suction box 16', FIG. 7*a* a convex suction box 16'', and finally, FIG. 7*b* a suction box 16''' having a substantially linear course or extent. By selecting an appropriate contour of the employed suction box there can be minimized the wear at the front edge of the suction box and there can be optimized the protection of the paper web which is guided in sandwich configuration between the coacting drying wires.

Figure 8:
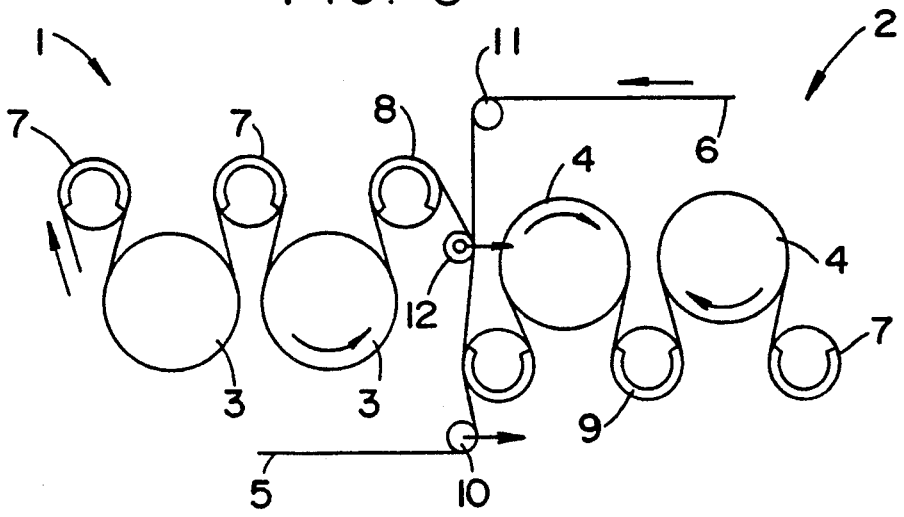
FIG. 8 is a schematic side view of an eighth exemplary embodiment of apparatus for interconnecting two groups of driers of a papermaking machine.
Figure 8A:
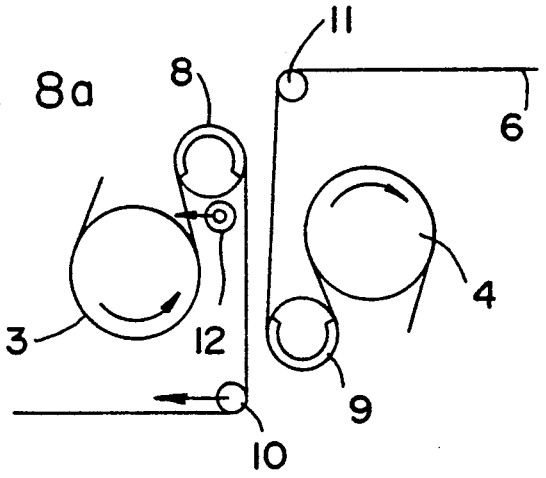
FIG. 8*a* illustrates the apparatus of FIG. 8 in an open condition between the two successive groups of driers.

Finally, with reference to the further embodiment depicted in FIGS. 8 and 8*a*, which is in principle similar to the arrangement of FIGS. 1 and 1*a*, there is here, however, depicted by way of example and not limitation that it is possible to position the deflection or turning rollers 7, 8 and 9 above or below the drying devices, specifically the drying cylinders 3 and 4, as shown, without departing from the inventive concepts. For instance, in the embodiment of FIGS. 1 and 1*a* the deflection rollers 7 and 8 of the preceding or upstream group of driers 1 are shown located below the neighboring drying cylinders 3 whereas the deflection rollers 7 and 9 of the succeeding or downstream group of driers 2 are located above the drying cylinders 4, but the reverse arrangement of the deflection rollers 7, 8 and 9 in relation to the corresponding drying cylinders 3 and 4 of the two groups of driers and 2, respectively, is shown for the modification of FIGS. 8 and 8*a*. The same observations hold true for the other exemplary embodiments previously considered.

While there are shown and described present preferred embodiments of the invention, it is distinctly to be understood the invention is not limited thereto, but may be otherwise variously embodied and practiced within the scope of the following claims.

What is claimed is:

1. An apparatus for interconnecting two groups of driers of a papermaking machine, wherein the groups of driers are suitable of drying a paper web, comprising:

at least two groups of driers successively following one another in a predetermined direction of travel of a paper web through said at least two groups of driers;

said at least two groups of driers comprising a plurality of heated drying devices for drying the paper web;

endless drying wire means for guiding the paper web over the plurality of heated drying devices in such a manner that the paper web is located between the endless drying wire means and an associated one of the drying devices;

said at least two groups of driers defining a transition location where the paper web is transferred from an upstream located one of the at least two groups of driers to a next following downstream located one of the at least two groups of driers as viewed with respect to the predetermined direction of travel of the paper web through said at least two groups of driers;

the paper web being guided from the upstream located group of driers into the next following downstream located group of driers at the transition located between the two groups of driers in such a manner that a side of the paper web which is situated opposite to the side of the paper web which confronted the drying devices of the upstream located group of driers now is located in confronting relationship with the drying devices of the next following downstream located groups of driers;

said endless drying wire means comprising a first endless drying wire for the upstream located group of driers and a separate second endless drying wire for the downstream located group of driers;

at least one deflection roller for the first endless drying wire and the paper web carried thereby provided for the upstream located group of driers downstream of a last one of the drying devices of the upstream located group of driers;

a further deflection roller provided for the first endless drying wire arranged downstream of the at least one deflection roller as viewed with respect to the predetermined direction of travel of the paper web through said at least two groups of driers;

said further deflection roller serving to deflect the first endless drying wire at a location where such first endless drying wire no longer carries the paper web;

said downstream located group of driers comprising a deflection roller arranged upstream of a first drying device of the second group of driers as viewed with respect to the predetermined direction of travel of the paper web through said at least two groups of driers;

said deflection roller of the second group of driers guiding the second endless drying wire of said second group of driers towards the first endless drying wire of the upstream located group of driers such that the second endless drying wire together with the first endless drying wire and the paper web arranged between the first and second endless drying wires forms a contact region;

a deflection device provided for the downstream arranged group of driers over which there is guided the second endless drying wire following separation of the first endless drying wire of the upstream located group of driers from the paper web;

said deflection device serving for guiding the paper web to the first drying device of the downstream located group of driers; and an adjustable contact roller located between the at least two groups of driers for altering the course of at least one of the endless drying wires at a region between both groups of driers such that there is possible separation of the first and second endless drying wires from one another at the transition location between both of the at least two groups of driers, wherein:

said adjustable contact roller, in an operating position of the apparatus, places and retains the first and second endless drying wires in contact with one another; and said adjustable contact roller being movable away from the first and second endless drying wires such that owing to tension of the first and second endless drying wires these first and second endless drying wires are separated from one another.

2. The apparatus according to claim 1, wherein:

the deflection device of the downstream arranged group of driers is arranged upstream of the first drying device of the second group of driers;

said adjustable contact roller for altering the course of at least one of the endless drying wires comprises a cleaning roller located above the deflection device arranged upstream of the first drying device of the second group of driers which guides the paper web located between the first endless drying wire and the second endless drying wire; and means for moving the cleaning roller in the direction of the first endless drying wire of the upstream group of driers such that in one position of the cleaning roller, in an operating position of the apparatus, both of the first and second endless drying wires can be placed and retained in contact with one another and in another position of the cleaning roller the first endless drying wire of the upstream group of driers can be separated from the second endless drying wire of the downstream of driers.

3. The apparatus according to claim 2, wherein:

said deflection roller of the second group of driers comprises a displaceable deflection roller member provided for the downstream located group of driers at a location directly upstream of the transition location as viewed with respect to the predetermined direction of travel of the paper web through said at least two groups of driers; and means for altering the position of the deflection roller member in order to augment separation of the first and second endless drying wires from one another.

4. The apparatus according to claim 2, wherein:

the at least one deflection roller for the first endless drying wire located downstream of the last one of the drying devices of the upstream located group of driers comprises a displaceable deflection roller in order to augment separation of the first and second endless drying wires from one another.

5. The apparatus according to claim 2, wherein:

the deflection device provided for the downstream arranged group of driers over which there is guided the second endless drying wire comprises a displaceable deflection device in order to augment separation of the first and second endless drying wires from one another.

6. The apparatus according to claim 1, wherein:

the adjustable contact roller located between the at least two groups of driers is constructed as a regulatable contact roller.

7. The apparatus according to claim 1, wherein:

the adjustable contact roller located between the at least two groups of driers is constructed as a controllable contact roller.

8. The apparatus according to claim 1, wherein:

said deflection roller of the second group of driers comprises a displaceable deflection roller member provided for the downstream located group of driers at a location directly upstream of the transition location as viewed with respect to the predetermined direction of travel of the paper web through said at least two groups of driers; and means for altering the position of the deflection roller member in order to augment separation of the first and second endless drying wires from one another.

9. The apparatus according to claim 8, wherein:

the at least one deflection roller for the first endless drying wire located downstream of the last one of the drying devices of the upstream located group of driers comprises a displaceable deflection roller in order to augment separation of the first and second endless drying wires from one another.

10. The apparatus according to claim 8, wherein:

the deflection device provided for the downstream arranged group of driers over which there is guided the second endless drying wire comprises a displaceable deflection device in order to augment separation of the first and second endless drying wires from one another.

11. The apparatus according to claim further including:

a displaceable deflection means provided for at least one of the endless drying wires and the paper web and located at the transition location between the at least two groups of driers in order to enable separation of the first and second endless drying wires from one another.

12. An apparatus for interconnecting two groups of driers of a papermaking machine, wherein the groups of driers are suitable for drying a paper web, comprising:

at least two groups of driers successively following one another in a predetermined direction of travel of a paper web through said at least two groups of driers;

said at least two groups of driers comprising a plurality of heating drying devices for drying the paper web;

endless drying wire means for guiding the paper web over the plurality of heated drying devices in such a manner that the paper web is located between the endless drying wire means and an associated one of the drying devices;

said at least two groups of driers defining a transition location where the paper web is transferred from an upstream located one of the at least two groups of driers to a next following downstream located one of the at least two groups of driers as viewed with respect to the predetermined direction of travel of the paper web through said at least two groups of driers;

the paper web being guided from the upstream located group of driers into the next following downstream located group of driers at the transition located between the two groups of driers in such a manner that a side of the paper web which is situated opposite to the side of the paper web which confronted the drying devices of the upstream located group of driers now is located in confronting relationship with the drying devices of the next following downstream located group of driers;

said endless drying wire means comprising a first endless drying wire for the upstream located group of driers and a separate second endless drying wire for the downstream located group of driers;

at least one deflection roller for the first endless drying wire and the paper web carried thereby provided for the upstream located group of driers downstream of a last one of the drying devices of the upstream located group of driers;

a further deflection roller provided for the first endless drying wire arranged downstream of the at least one deflection roller as viewed with respect to the predetermined direction of travel of the paper web through said at least two groups of driers;

said further deflection roller serving to deflect the first endless drying wire at a location where such first endless drying wire no longer carries the paper web;

said downstream located group of driers comprising a deflection roller arranged upstream of a first drying device of the second group of driers as viewed with respect to the predetermined direction of travel of the paper web through said at least two group of driers;

said deflection roller of the second group of driers guiding the second endless drying wire of said second group of driers towards the first endless drying wire of the upstream located group of driers such that the second endless drying wire together with the first endless drying wire and the paper web arranged between the first and second endless drying wires forms a contact region;

a deflection device provided for the downstream arranged group of driers over which there is guided the second endless drying wire following separation of the first endless drying wire of the upstream located group of driers from the paper web;

said deflection device serving for guiding the paper web to the first drying device of the downstream located group of driers; and a suction box, located between the at least one deflection roller for the first endless drying wire and the deflection device, said suction box comprising means for altering the course of at least one of the endless drying wires at a region between both groups of driers such that there is possible separation of the first and second endless drying wires from one another at the transition location between both of the at least two groups of driers.

13. The apparatus according to claim 12, wherein:

said suction box being positionable such that said suction box further comprises:

means for placing into contact with one another the first and second endless drying wires and the paper web located therebetween due to vacuum conditions prevailing in the suction box, and means for releasing the first and second endless drying wires from one another and for permitting movement of the first and second endless drying wires past one another without contact one another in the absence of the vacuum conditions in the suction box.

14. An apparatus for interconnecting two groups of driers of a papermaking machine, wherein the groups of driers are suitable for drying a paper web, comprising:

at least two groups of driers successively following one another in a predetermined direction of travel of a paper web through said at least two groups of driers;

said at least two groups comprising a plurality of heating drying devices for drying the paper web;

endless drying wire means for guiding the paper web over the plurality of heated drying devices in such a manner that the paper web is located between the endless drying wire means and an associated one of the drying devices;

said at least two groups of driers defining a transition location where the paper web is transferred from an upstream located one of the at least two groups of driers to a next following downstream located one of the at least two groups of driers as viewed with respect to the predetermined direction of travel of the paper web through said at least two groups of driers;

the paper web being guided from the upstream located group of driers into the next following downstream located group of driers at the transition located between the two groups of driers in such a manner that a side of the paper web which is situated opposite to the side of the paper web which confronted the drying devices of the upstream located group of driers now is located in confronting relationship with the drying devices of the next following downstream located group of driers;

said endless drying wire means comprising a first endless drying wire for the upstream located group of driers and a separate second endless drying wire for the downstream located group of driers;

at least one deflection roller for the first endless drying wire and the paper web carried thereby provided for the upstream located group of driers downstream of a last one of the drying devices of the upstream located group of driers;

a further deflection roller provided for the first endless drying wire arranged downstream of the at least one deflection roller as viewed with respect to the predetermined direction of travel of the paper web through said at least two groups of driers;

said further deflection roller serving to deflect the first endless drying wire at a location where such first endless drying wire no longer carries the paper web;

said downstream located group of driers comprising a deflection roller arranged upstream of a first drying device of the second group of driers as viewed with respect to the predetermined direction of travel of the paper web through said at least two groups of driers;

said deflection roller of the second group of driers guiding the second endless drying wire of said second group of driers towards the first endless drying wire of the upstream located group of driers such that the second endless drying wire together with the first endless drying wire and the paper web arranged between the first and second endless drying wires forms a contact region;

a deflection device provided for the downstream arranged group of driers over which there is guided the second endless drying wire following separation of the first endless drying wire of the upstream located group of driers from the paper web;

said deflection device serving for guiding the paper web to the first drying device of the downstream located group of driers; and a suction box, located between the at least one deflection roller for the first endless drying wire and the deflection device, for altering the course of at least one of the endless drying wires at a region between both groups of driers such that there is possible separation of the first and second endless drying wires from one another at the transition location between both of the at least two groups of driers;

the suction box being positionable such that due to vacuum conditions prevailing in the suction box both the first and second endless drying wires and the paper web located therebetween are placed into contact with one another, and in the absence of the vacuum conditions in the suction box the first and second endless drying wires are released from one another and can move past one another without contacting one another; and the suction box possesses a substantially concave configuration with respect to the first and second endless drying wires.

15. The apparatus according to claim 13, further including:

means for controlling the vacuum conditions prevailing in the suction box.

16. The apparatus according to claim 12, wherein:

said suction box being movable in the direction of the first and second endless drying wires to such an extent that the suction box comes into contact with a neighboring one of the first and second endless drying wires and displaces such neighboring endless drying wire together with the paper web into the other endless drying wire.

17. The apparatus according to claim 16, wherein:

the suction box possesses a substantially convex configuration with respect to the first and second endless drying wires.

18. The apparatus according to claim 16, further including:

means for controlling the vacuum conditions prevailing in the suction box.

* * * * *